US011856376B2

(12) United States Patent
Zheng et al.

(10) Patent No.: US 11,856,376 B2
(45) Date of Patent: Dec. 26, 2023

(54) SOUND ACQUISITION COMPONENT ARRAY AND SOUND ACQUISITION DEVICE

(71) Applicant: Tencent Technology (Shenzhen) Company Limited, Shenzhen (CN)

(72) Inventors: Jimeng Zheng, Shenzhen (CN); Yi Gao, Shenzhen (CN); Xuan Ji, Shenzhen (CN); Weiwei Li, Shenzhen (CN); Meng Yu, Shenzhen (CN); Kai Xia, Shenzhen (CN); Jun Feng, Shenzhen (CN); Zhu Chen, Shenzhen (CN); Hongyang Chen, Shenzhen (CN); Wenbin Yang, Shenzhen (CN); Yu Wang, Shenzhen (CN); Yong Liu, Shenzhen (CN)

(73) Assignee: TENCENT TECHNOLOGY (SHENZHEN) COMPANY LIMITED, Shenzhen (CN)

( * ) Notice: Subject to any disclaimer, the term of this patent is extended or adjusted under 35 U.S.C. 154(b) by 281 days.

(21) Appl. No.: 17/319,024

(22) Filed: May 12, 2021

(65) Prior Publication Data

US 2021/0266664 A1 Aug. 26, 2021

Related U.S. Application Data

(63) Continuation of application No. PCT/CN2019/128338, filed on Dec. 25, 2019.

(30) Foreign Application Priority Data

Dec. 27, 2018 (CN) ..... 201811610594.2

(51) Int. Cl.
*H04R 3/00* (2006.01)

(52) U.S. Cl.
CPC ..... *H04R 3/005* (2013.01)

(58) Field of Classification Search
CPC ..... H04R 3/005; H04R 29/00; H04R 29/005
(Continued)

(56) References Cited

U.S. PATENT DOCUMENTS 9,294,860 B1 * 3/2016 Carlson ..... H04R 3/005
2012/0263333 A1 10/2012 Akino
(Continued)

FOREIGN PATENT DOCUMENTS

CN 106723736 A 5/2017
CN 107943449 A 4/2018
(Continued)

OTHER PUBLICATIONS

Tencent Technology, ISR, PCT/CN2019/128338, Mar. 25, 2020, 2 pgs.
(Continued)

*Primary Examiner* — William A Jerez Lora
(74) *Attorney, Agent, or Firm* — Morgan, Lewis & Bockius LLP

(57) ABSTRACT

This application discloses a sound acquisition component array, including: two first sound acquisition components, two second sound acquisition components, and two third sound acquisition components. The two second sound acquisition components are located at a first side of a line connecting the two first sound acquisition components, and the two third sound acquisition components are located at a second side of the connecting line that is opposite to the first side of the connecting line; the two second sound acquisition components are symmetrical about a perpendicular bisector of the connecting line, and the two third sound acquisition components are symmetrical about the perpendicular bisector; and a distance between the two first sound acquisition components, a distance between the two second sound acquisition components, and a distance between the two
(Continued)

third sound acquisition components are respectively different from one another along a direction defined by the connecting line.

20 Claims, 13 Drawing Sheets

(58) Field of Classification Search
USPC ..... 381/56, 58, 91, 122, 355
See application file for complete search history.

(56) References Cited

U.S. PATENT DOCUMENTS

| | | | | |
|---|---|---|---|---|
| 2013/0201162 | A1 | 8/2013 | Cavilia | |
| 2014/0219472 | A1 | 8/2014 | Huang et al. | |
| 2017/0094223 | A1* | 3/2017 | Burenius | H04N 7/147 |
| 2018/0182392 | A1* | 6/2018 | Li | H04R 1/406 |
| 2019/0132672 | A1* | 5/2019 | Dick | H04R 3/005 |

FOREIGN PATENT DOCUMENTS

| | | | |
|---|---|---|---|
| CN | 108156559 | A | 6/2018 |
| CN | 207495509 | U | 6/2018 |
| CN | 108471561 | A | 8/2018 |
| CN | 108632653 | A | 10/2018 |
| CN | 109660918 | A | 4/2019 |

OTHER PUBLICATIONS

Zhongguancun Online, "8-Inch HD Display Tencent Dingdong Smartscreen First Evaluation", Dec. 18, 2018, 9 pgs., Retrieved on the Internet: https://baijiahao.baidu.com/s?id=1620183630263608564&wfr=spider&for=pc.

Tencent Technology, WO, PCT/CN2019/128338, Mar. 25, 2020, 4 pgs.

Tencent Technology, IPRP, PCT/CN2019/128338, Jun. 16, 2021, 5 pgs.

* cited by examiner

SOUND ACQUISITION COMPONENT ARRAY AND SOUND ACQUISITION DEVICE

CROSS REFERENCE TO RELATED APPLICATIONS

This application is a continuation application of PCT Patent Application No. PCT/CN2019/128338, entitled "SOUND COLLECTION ASSEMBLY ARRAY AND SOUND COLLECTION DEVICE" filed on Dec. 25, 2019, which claims priority to Chinese Patent Application No. 201811610594.2, filed with the State Intellectual Property Office of the People's Republic of China on Dec. 27, 2018, and entitled "SOUND ACQUISITION COMPONENT ARRAY AND SOUND ACQUISITION DEVICE", all of which are incorporated herein by reference in their entirety.

FIELD OF THE TECHNOLOGY

This application relates to the field of acoustics processing technologies, and in particular, to a sound acquisition component array and a sound acquisition device.

BACKGROUND OF THE DISCLOSURE

Smart devices that support far-field speech interaction are usually equipped with sound acquisition components array to strengthen speech recognition performance. Therefore, a structure and a directional ability of a sound acquisition component array become important in a far-field speech interaction solution.

To take a product appearance design of a smart device into consideration, an oval sound acquisition component array formed by using eight sound acquisition components arranged in an oval shape is provided in the related art. In the eight sound acquisition components, two groups of sound acquisition components, each group including three sound acquisition components, are disposed at two sides of the x-axis of a rectangular coordinate system respectively, and the remaining two sound acquisition components are disposed on the x-axis. The eight sound acquisition components are symmetrical about the x-axis and the y-axis of the rectangular coordinate system and an overall structure of the eight sound acquisition components is of an elongated shape.

However, during processing of audio signals acquired by the oval sound acquisition component array in the related art, audio signals acquired by the eight sound acquisition components need to be processed, which results in a larger volume of to-be-processed data and affects processing efficiency.

SUMMARY

A sound acquisition component array and a sound acquisition device are provided according to various embodiments of this application.

According to a first aspect of this application, a sound acquisition component array is provided, including two first sound acquisition components, two second sound acquisition components, and two third sound acquisition components, the two second sound acquisition components being located at a first side of a line connecting the two first sound acquisition components, the two third sound acquisition components being located at a second side of the connecting line that is opposite to the first side of the connecting line;

the two second sound acquisition components being symmetrical about a perpendicular bisector of the connecting line, the two third sound acquisition components being symmetrical about the perpendicular bisector; and a distance between the two first sound acquisition components along a first direction of the connecting line, a distance between the two second sound acquisition components along a second direction parallel to the connecting line, and a distance between the two third sound acquisition components along a third direction parallel to the connecting line are respectively different from one another.

According to a second aspect of this application, a sound acquisition component array is provided, including two first sound acquisition components, two second sound acquisition components, and two third sound acquisition components, the two second sound acquisition components being located at a first side of a line connecting the two first sound acquisition components, the two third sound acquisition components being located at a second side of the connecting line that is opposite to the first side of the connecting line;

the two second sound acquisition components being symmetrical about a perpendicular bisector of the connecting line, the two third sound acquisition components being symmetrical about the perpendicular bisector; and a distance between the two first sound acquisition components along a first direction of the connecting line being greater than a distance between the two third sound acquisition components along a third direction parallel to the connecting line and the distance between the two third sound acquisition components along the third direction being greater than a distance between the two second sound acquisition components along a second direction parallel to the connecting line.

A sound acquisition device is provided, including the foregoing sound acquisition component arrays.

Details of one or more embodiments of this application are provided in the accompanying drawings and descriptions below. Other features, objectives, and advantages of this application become apparent from the specification, the accompanying drawings, and the claims.

BRIEF DESCRIPTION OF THE DRAWINGS

To describe the technical solutions in the embodiments of this application more clearly, the accompanying drawings required for describing the embodiments are briefly described hereinafter. Apparently, the accompanying drawings in the following description show merely some embodiments of this application, and a person of ordinary skill in the art may obtain other accompanying drawings according to these accompanying drawings without creative efforts.

DESCRIPTION OF EMBODIMENTS

The following clearly and comprehensively describes the technical solutions in the embodiments of this application with reference to the accompanying drawings in the embodiments of this application. Apparently, the described embodiments are some embodiments of this application rather than all of the embodiments. All other embodiments obtained by a person of ordinary skill in the art based on the embodiments of this application without creative effects shall fall within the protection scope of this application. When the following descriptions are made with reference to the accompanying drawings, unless otherwise indicated, the same numbers in different accompanying drawings represent the same or similar elements.

With the popularity of smart speakers and derivatives thereof, speech interaction between humans and machines, especially far-field speech interaction, has gradually become an important man-machine interaction interface and is considered as the most important user traffic entrance in the future. A sound acquisition device provided with a sound acquisition component may acquire audio signals from surrounding space and process the audio signals in a predetermined manner, to implement applications such as speech-based man-machine interaction.

According to different specific application scenarios, the sound acquisition device may also have different product forms. For example, the sound acquisition device may include but is not limited to at least one of a smart speaker, a smart television, a smart television set-top box, a smart robot, and a smart in-vehicle device.

Figure 1:
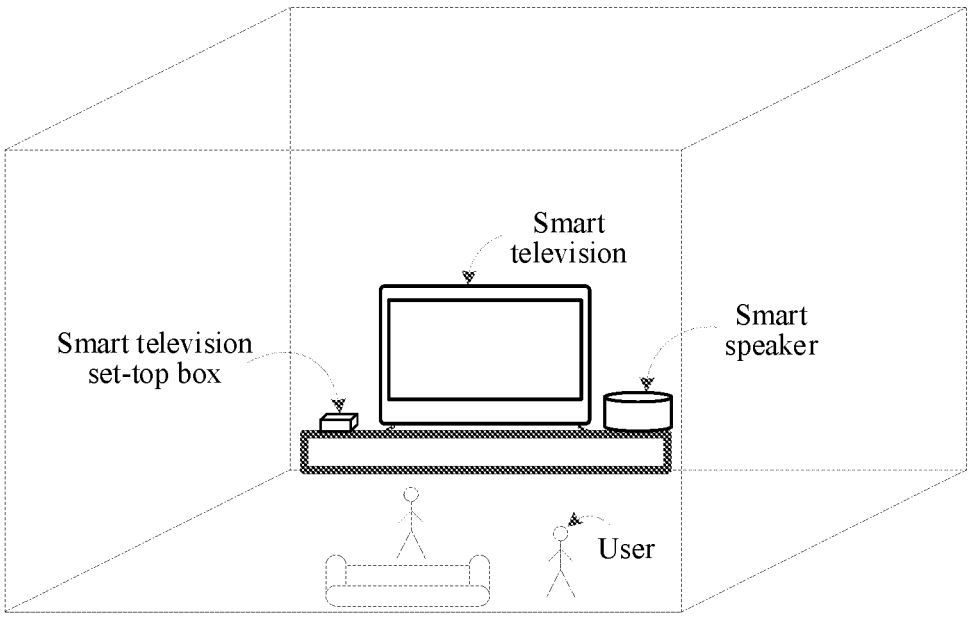
FIG. 1 is a schematic diagram of a far-field speech interaction scenario according to this application.

For example, FIG. 1 is a schematic diagram of a far-field speech interaction scenario according to this application. As shown in FIG. 1, sound acquisition devices such as a smart television, a smart television set-top box, and a smart speaker are placed in a room. A user may send a control speech such as "turning down the volume" at any position in the room. The control speech sent by the user may be transmitted to a sound acquisition device through air. After the control speech is received by a sound acquisition component disposed in the sound acquisition device, the sound acquisition device performs steps such as processing and recognition on the control speech, to obtain a corresponding control instruction and control the volume to be turned down.

With the development of application scenarios of sound acquisition and processing technologies, requirements on sound acquisition components are increasingly high. Currently, a sound acquisition component array formed by a plurality of sound acquisition components is proposed in the industry, so as to improve audio signal acquisition performance and support more functions. A sound acquisition component array taking both performance and product appearance into consideration is provided in the solutions shown in this application.

Before the solutions shown in this application are described, several terms in the solutions of this application are described first.

1. Sound Acquisition Component

In this application, a sound acquisition component refers to a hardware device component used for transforming a sound (waves generated by vibrations of an object) into an analog signal (electrical signal). In some embodiments, some sound acquisition components may further transform the obtained analog signal into a digital sampling signal.

The sound acquisition component may include a microphone, a pickup, a sound sensor, or the like according to various circuit structures.

2. Sound Acquisition Component Array

Generally, the sound acquisition component may acquire audio signals at only one point, and acquisition performance and functions that can be implemented are relatively limited. Therefore, to improve the performance and functions of sound acquisition, a solution in which a plurality of sound acquisition components are arranged at different spatial positions to form a sound acquisition component array is provided in the related art. Audio signals acquired by the plurality of sound acquisition components in the sound acquisition component array are centrally processed by using an audio signal processing chip, so that the performance of sound acquisition can be improved and new functions can be developed. For example, in a smart device having a speech recognition function, by using a plurality of sound acquisition component arrays formed by a plurality of sound acquisition components, a speech of a target user may be strengthened, noise in an environment may be suppressed, and a sound source direction may be positioned, thereby finally improving speech recognition performance in a speech interaction (especially far-field speech interaction) scenario.

Figure 2:
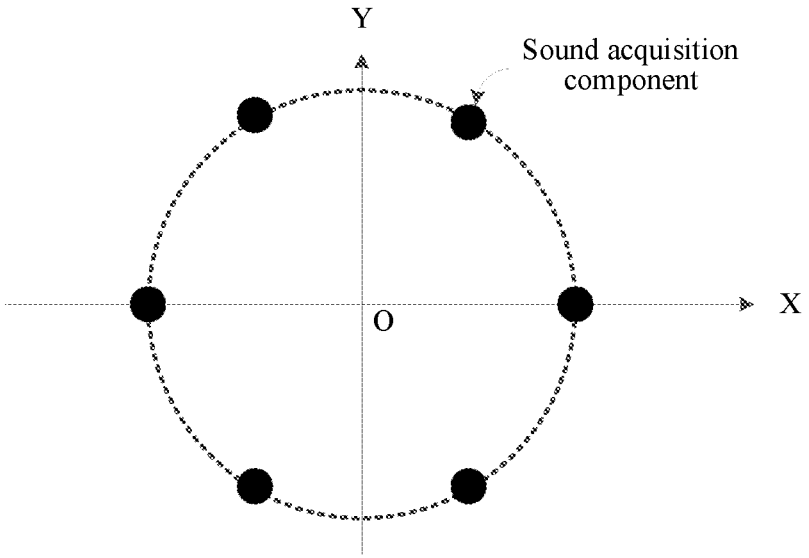
FIG. 2 is a schematic diagram of an annular sound acquisition component array according to the related art.

In the related art, an annular array is a common array in sound acquisition component arrays. FIG. 2 is a schematic diagram of an annular sound acquisition component array according to the related art. As shown in FIG. 2, the annular sound acquisition component array includes six sound acquisition components. The six sound acquisition components are distributed on a circular boundary with an origin of a rectangular coordinate system as a center of the circle. Positions of the six sound acquisition components satisfy the following formula:

$$\{(x_i=r\cdot\cos((i-1)*60°), y_i=r\cdot\sin((i-1)*60°))|i=1,2,\ldots,6\},$$

where r is a radius of a ring, that is, the foregoing six sound acquisition components are evenly distributed on the circular boundary with the origin of the rectangular coordinate system as the center of the circle, and two of the sound acquisition components are located on the x-axis of the rectangular coordinate system.

A steering vector of the sound acquisition component array is defined as a(θ, φ, f), and an expression of the a(θ, φ, f) is as follows:

$$\left[e^{j\frac{2\pi f}{c}[x_1 cos(\theta)cos(\varphi)+y_1 cos(\theta)sin(\varphi)]}, \ldots, e^{j\frac{2\pi f}{c}[x_6 cos(\theta)cos(\varphi)+y_6 cos(\theta)sin(\varphi)]}\right]^T,$$

where θ is a pitch angle, and $0 \le \theta \le 90$; φ is an azimuth angle, and $0 \le \varphi \le 360$; f is a designated frequency, and c is a sound transmission speed. The physical meaning of the steering vector may be understood as a phase and amplitude of an output signal of each sound acquisition component in the array when a plane wave signal of zero phase and unit intensity is incident on the array from direction (θ, φ).

In this case, an "array intrinsic lobe pattern" of the sound acquisition component array is defined as $B(\theta_0, \varphi_0, \theta, \varphi, f)$, and an expression of the $B(\theta_0, \varphi_0, \theta, \varphi, f)$ is as follows:

$$\|a(\theta_0,\varphi_0,f)^H a(\theta,\varphi,f)\|^2/N^2, 0 \le \theta \le 90,\ 0 \le \varphi \le 360,$$

where N is a quantity of sound acquisition components, $(\theta_0, \varphi_0)$ is a given target direction (also referred to as a main direction of the lobe pattern), and (θ, φ) is a scanning direction (that is, all possible incident directions in space are scanned point by point). The physical meaning of a lobe pattern B is an extent to which the sound acquisition component array can distinguish between a signal from the direction $(\theta_0, \varphi_0)$ and a signal from the direction (θ, φ) at a given frequency point f, that is, a gain of the signal from the direction $(\theta_0, \varphi_0)$ relative to the signal from the direction (θ, φ).

Figure 3:
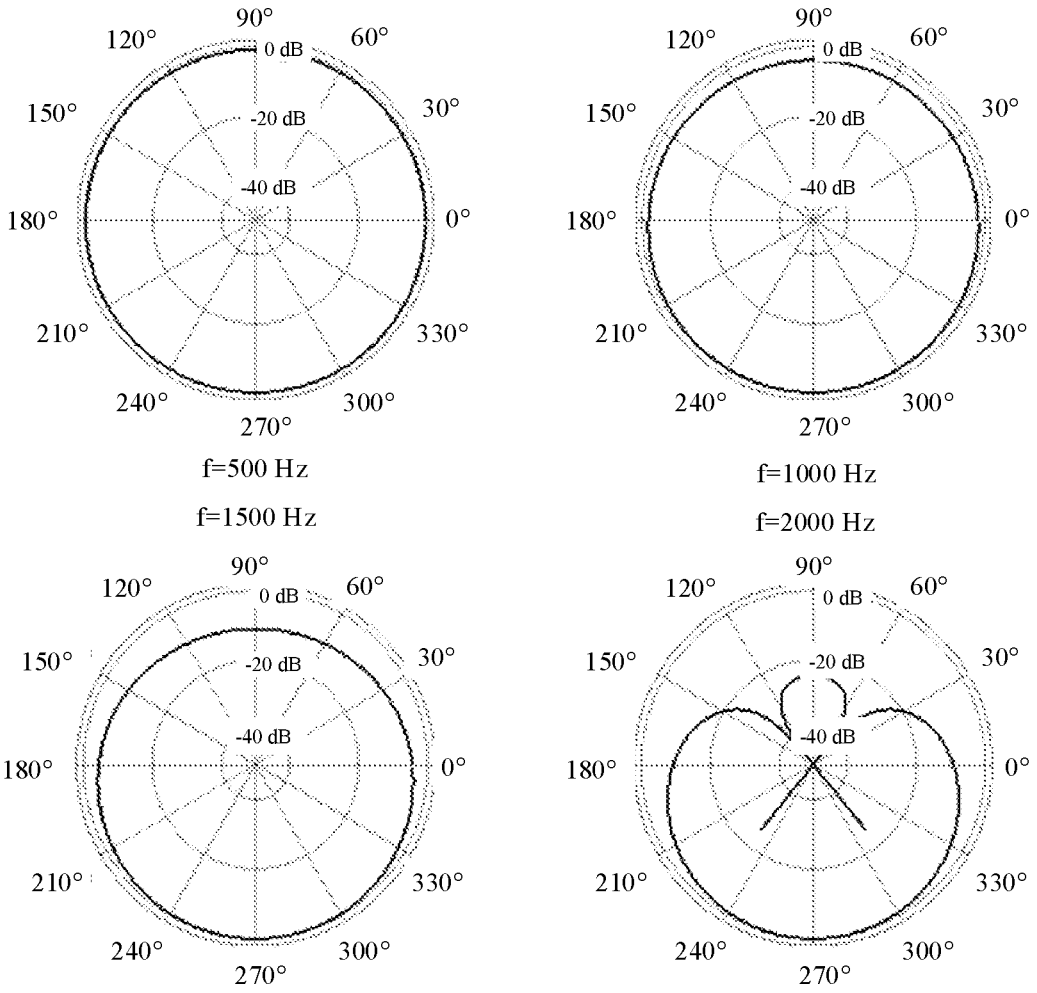
FIG. 3 is an intrinsic lobe pattern of the annular array with six sound acquisition components according to FIG. 2.

FIG. 3 is an intrinsic lobe pattern of the annular array with six sound acquisition components according to FIG. 2. Using r=3.5 cm (a classic value) as an example, for display simplicity of the lobe pattern, it is set fixedly that $\theta_0=\theta=0°$. In this case, f=500 Hz, 1000 Hz, 1500 Hz and 2000 Hz are used. These four frequency points are commonly used and important for speech signal processing. The intrinsic lobe pattern is displayed by using $\varphi_0=270$ as an example. Intrinsic lobe patterns at other angles (according to a principle of rotational symmetry) are similar to FIG. 3, except that the intrinsic lobe patterns at other angles rotate around the origin in FIG. 3.

To ensure that a direct sound transmission path between the sound acquisition component array and a target speaker is not blocked, the sound acquisition component array often needs to be arranged on a top surface or a front surface of a smart device. Therefore, the shape and an occupied area of the sound acquisition component array constitute a limitation on a product appearance and structure. By using an annular array widely used in products such as a smart speaker on the market currently as an example, an occupied area thereof is a circle with a radius of approximately 3.5 cm. Therefore, the appearance design of a smart speaker equipped with such a sound acquisition component array usually adopts a cylindrical shape or a shape similar to a cylinder, while the thickness of a hardware product cannot be reduced, and it is difficult to place such a hardware product in people's home.

Figure 4:
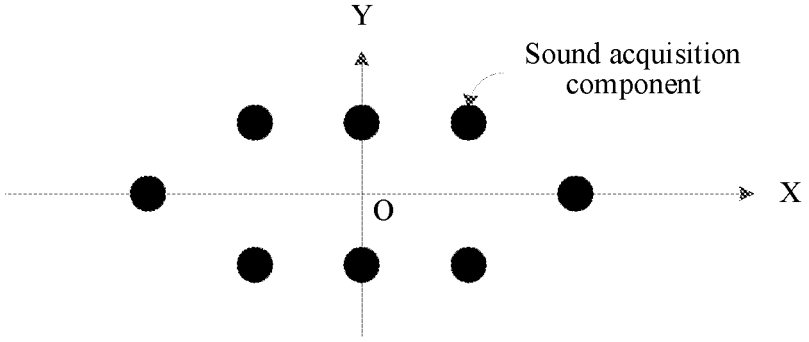
FIG. 4 is a schematic diagram of an oval sound acquisition component array according to the related art.

To take a product appearance design of a square device into consideration, an oval array with eight sound acquisition components is further provided in the related art. FIG. 4 is a schematic diagram of an oval sound acquisition component array according to the related art. As shown in FIG. 4, the oval sound acquisition component array includes eight sound acquisition components, and coordinates of an $i^{th}$ sound acquisition component in a rectangular coordinate system are $(x_i, y_i)$, where $1 \le i \le 8$. Coordinates of the foregoing eight sound acquisition components in the rectangular coordinate system are as follows:

$$(x_1,y_i)=(d_x,d_y),\ (x_2,y_2)(0,d_y),\ (x_3,y_3)=(-d_x,d_y),$$

$$(x_4,y_4)=(-2d_x,0),\ (x_5,y_5)=(-d_x,-d_y),\ (x_6,y_6)=(0,-d_y),$$

$$(x_7,y_7)=(d_x,-d_y),\ (x_8,y_8)=(2d_x,0),$$

where $d_x$ and $d_y$ are distances of a sound acquisition component on the x axis and y axis, and classic values of $d_x$ and $d_y$ in a speech recognition application scenario are as follows: $d_x$=2.25 cm and $d_y$=1.2 cm.

Figure 5:
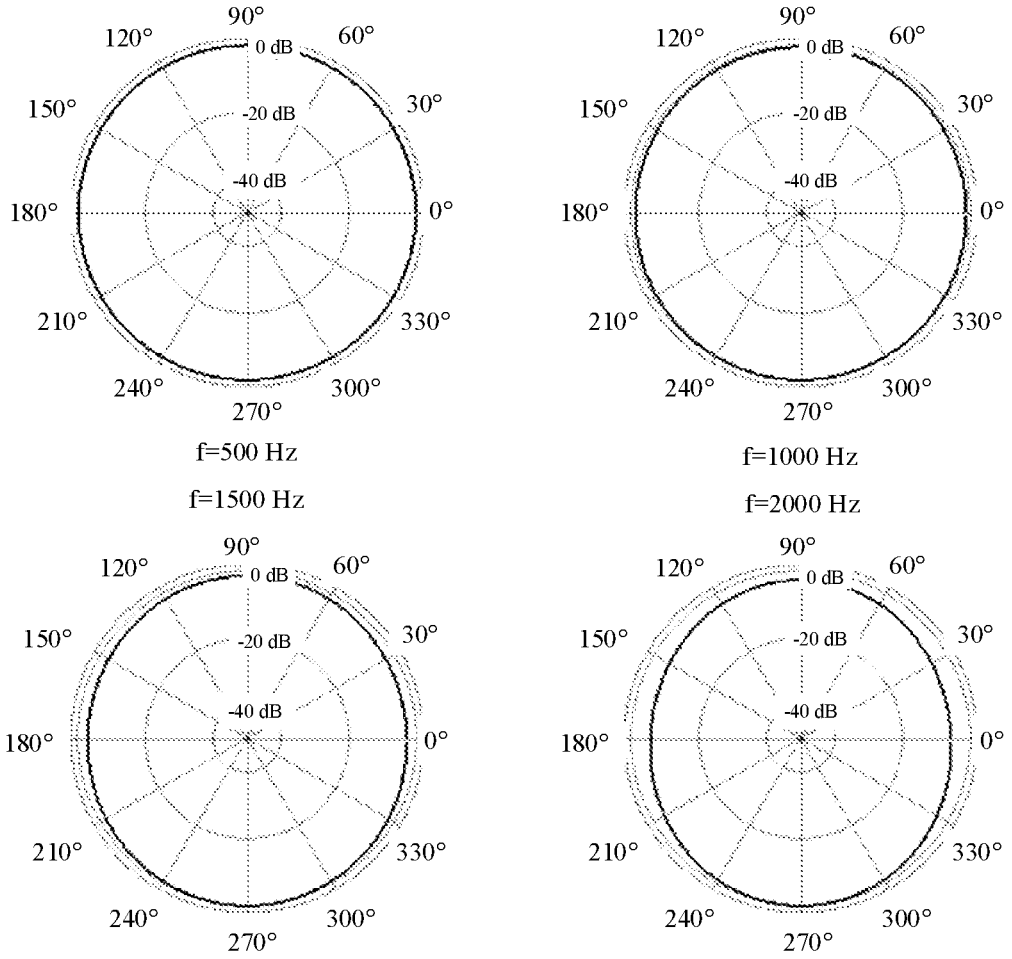
FIG. 5 is an intrinsic lobe pattern of the oval array with eight sound acquisition components according to FIG. 4.

FIG. 5 is an intrinsic lobe pattern of the oval array with eight sound acquisition components according to FIG. 4. Due to the arrangement of such an array on the product appearance, a user speaks from a 270-degree direction in most cases. Therefore, $\varphi_0=270°$ is still selected to display an intrinsic lobe pattern of the oval array in FIG. 5.

There is a small quantity of sound acquisition components in the annular array with six sound acquisition components shown in FIG. 1. However, it is difficult for an array structure thereof to adapt to a relatively narrow plane. Although an oval array with eight sound acquisition components adapts to a relatively narrow plane, more data needs to be processed, thus affecting processing efficiency.

Therefore, an array with six sound acquisition components structure that occupies an elongated area (such as a rectangle area or an oval area) is provided in this application. A sound acquisition component array of such a structure may be arranged on smart hardware having an elongated top or front surface, and can maintain a similar spatial distinguishing capability (especially in a main direction 270° used by a user).

Figure 6:
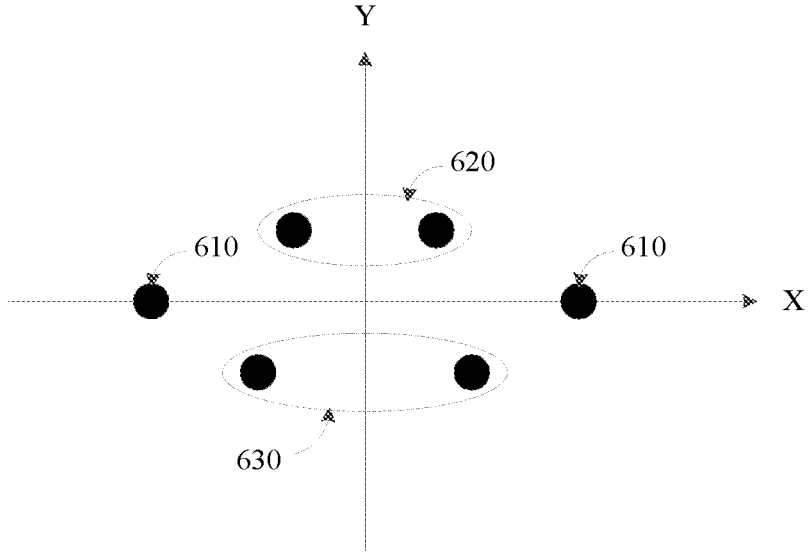
FIG. 6 is a schematic diagram of a sound acquisition component array according to an embodiment of this application.

FIG. 6 is a schematic diagram of a sound acquisition component array according to an embodiment of this application. The sound acquisition component array may be applied to a sound acquisition device. For example, the sound acquisition device may include but is not limited to a smart speaker, a smart television, a smart television set-top box, a smart robot, a smart in-vehicle device, and the like. As shown in FIG. 6, a sound acquisition component array 600 includes:

two first sound acquisition components 610, two second sound acquisition components 620, and two third sound acquisition components 630.

The two second sound acquisition components 620 are located at a first side of a line connecting the two first sound acquisition components 610, and the two third sound acquisition components 630 are located at a second side of the connecting line opposite to the first side of the connecting line. The two second sound acquisition components 620 are symmetrical about a perpendicular bisector of the connecting line, and the two third sound acquisition components 630 are symmetrical about the perpendicular bisector. A distance between the two first sound acquisition components 610 is greater than a distance between the two second sound acquisition components 620, and the distance between the two first sound acquisition components 610 is greater than a distance between the two third sound acquisition components 630. The distance between the two second sound acquisition components 620 is different from the distance between the two third sound acquisition components 630.

In order to more intuitively describe a relative position relationship of the foregoing six sound acquisition components, a rectangular coordinate system is used as a reference in FIG. 6. The two first sound acquisition components 610 are located at two sides of an origin on the x-axis of the rectangular coordinate system respectively. A distance between the first sound acquisition component 610 and the y-axis of the rectangular coordinate system is a first length.

The two second sound acquisition components 620 are located in a first quadrant and a second quadrant of the rectangular coordinate system respectively. A vertical distance between the second sound acquisition component 620 and the y-axis of the rectangular coordinate system is a second length, and a vertical distance between the second sound acquisition component 620 and the x-axis is a third length.

The two third sound acquisition components 630 are respectively located in a third quadrant and a fourth quadrant of the rectangular coordinate system. A vertical distance between the third sound acquisition component 630 and the y-axis of the rectangular coordinate system is a fourth length, and a vertical distance between the third sound acquisition component 630 and the x-axis is a fifth length.

The first length is greater than the second length, the first length is greater than the fourth length, and the second length is different from the fourth length.

The solution in this embodiment of this application provides an array with six sound acquisition components, which is symmetrical about a perpendicular bisector of a connecting line between two sound acquisition components, but is not symmetrical about the connecting line between the two sound acquisition components. The array with six sound acquisition components can adapt to an elongated appearance design extending along a direction of the connecting line between the two sound acquisition components. Moreover, the array with six sound acquisition components has fewer sound acquisition components compared with an array with eight sound acquisition components, and less data needs to be processed during audio signal processing, thereby improving the efficiency of audio signal processing while achieving adaptability to the elongated appearance design.

Figure 7:
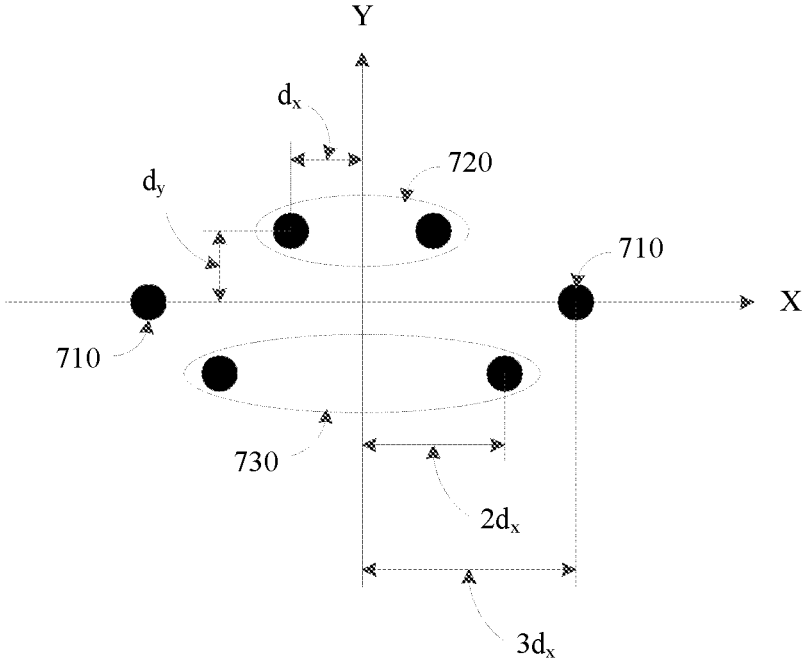
FIG. 7 is a schematic diagram of a sound acquisition component array according to an embodiment of this application.

FIG. 7 is a schematic diagram of a sound acquisition component array according to an embodiment of this application. The sound acquisition component array may be applied to a sound acquisition device. For example, the sound acquisition device may include but is not limited to a smart speaker, a smart television, a smart television set-top box, a smart robot, a smart in-vehicle device, and the like. As shown in FIG. 7, a sound acquisition component array 700 includes:

two first sound acquisition components 710, two second sound acquisition components 720, and two third sound acquisition components 730.

The two second sound acquisition components 720 are located at a first side of a line connecting the two first sound acquisition components 710, and the two third sound acquisition components 730 are located at a second side of the connecting line opposite to the first side of the connecting line. The two second sound acquisition components 720 are symmetrical about a perpendicular bisector of the connecting line, and the two third sound acquisition components 730 are symmetrical about the perpendicular bisector. A distance between the two first sound acquisition components 710 is greater than a distance between the two second sound acquisition components 720, and the distance between the two first sound acquisition components 710 is greater than a distance between the two third sound acquisition components 730.

The distance between the two second sound acquisition components 720 is different from the distance between the two third sound acquisition components 730.

In order to more intuitively describe a relative position relationship of the foregoing six sound acquisition components, a rectangular coordinate system is used as a reference in FIG. 7. As shown in FIG. 7, the six sound acquisition components in the sound acquisition component array 700 are disposed according to the rectangular coordinate system.

The two first sound acquisition components 710 are located at two sides of an origin on the x-axis of the rectangular coordinate system respectively. A distance between the first sound acquisition component 710 and the y-axis of the rectangular coordinate system is a first length.

The two second sound acquisition components 720 are located in a first quadrant and a second quadrant of the rectangular coordinate system respectively. A vertical distance between the second sound acquisition component 720 and the y-axis of the rectangular coordinate system is a second length, and a vertical distance between the second sound acquisition component 720 and the x-axis is a third length.

The two third sound acquisition components 730 are located in a third quadrant and a fourth quadrant of the rectangular coordinate system respectively. A vertical distance between the third sound acquisition component 730 and the y-axis of the rectangular coordinate system is a fourth length, and a vertical distance between the third sound acquisition component 730 and the x-axis is a fifth length.

The first length is greater than the second length, the first length is greater than the fourth length, and the second length is different from the fourth length.

In this embodiment of this application, the distance between the two first sound acquisition components 710, the distance between the two second sound acquisition components 720, and the distance between the two third sound acquisition components 730 may follow a certain ratio.

For example, in a possible implementation, the distance between the two first sound acquisition components 710 is three times the distance between the two second sound acquisition components 720, and the distance between the two third sound acquisition components 730 is twice the distance between the two second sound acquisition components 720.

Accordingly, corresponding to the sound acquisition component array disposed according to the rectangular coordinate system shown in FIG. 7, the first length is three times the second length, and the fourth length is twice the second length.

For example, in another possible implementation, a ratio of the distance between the two first sound acquisition components 710 to the distance between the two second sound acquisition components 720 and/or a ratio of the distance between the two third sound acquisition components 730 to the distance between the two second sound acquisition components 720 may be other values. For example, the distance between the two first sound acquisition components 710 may be 2.8 times or 3.2 times the distance between the two second sound acquisition components 720, and the distance between the two third sound acquisition components 730 may be 1.8 times or 2.2 times the distance between the two second sound acquisition components 720.

In this embodiment of this application, a vertical distance between the second sound acquisition component 720 and a connecting line of the two first sound acquisition components 710 and a vertical distance between the third sound acquisition component 730 and the connecting line may follow a certain proportional relation.

For example, in a possible implementation, the vertical distance between the second sound acquisition component 720 and the connecting line of the two first sound acquisition components 710 is the same as the vertical distance between the third sound acquisition component 730 and the connecting line.

Accordingly, corresponding to the sound acquisition component array disposed according to the rectangular coordinate system shown in FIG. 7, the third length is the same as the fifth length.

Alternatively, in another possible implementation, the vertical distance between the second sound acquisition component 720 and the connecting line of the two first sound acquisition components 710 may be different from the vertical distance between the third sound acquisition component 730 and the connecting line. For example, corresponding to the sound acquisition component array disposed according to the rectangular coordinate system shown in FIG. 7, a ratio of the third length to the fifth length may be 10:9 or 5:4.

For example, the sound acquisition component is a microphone (mic), the first length is three times the second length, the fourth length is twice the second length, and the third length is the same as the fifth length. The array shown in FIG. 7 is an asymmetric oval array with six mics, and positions of the mics are as follows:

$$(x_1,y_1)=(3d_x,0),\ (x_2,y_2)=(d_x,d_y),\ (x_3,y_3)=(-d_x,d\ d_y),$$

and $$(x_4,y_4)=(-3d_x,0),\ (x_5,y_5)=(-2d_x,-d_y),\ (x_6,y_6)=(2d_x,-d_y),$$

where $d_x$ and $d_y$ are distances of corresponding mics on the x-axis (the horizontal axis) and the y-axis (the vertical axis) of the rectangular coordinate system, and classic values of $d_x$ and $d_y$ in a speech recognition application scenario are as follows: $d_x$=1.5 cm and $d_y$=1.2 cm. Therefore, for the asymmetric oval array with six mics, an aperture length of the whole array on the x-axis is 9 cm, which is consistent with that of the oval array with eight sound acquisition components shown in FIG. 4, and an aperture length of the whole array on the y-axis is 2.4 cm, which is also consistent with that of the oval array with eight sound acquisition components shown in FIG. 4.

In some embodiments, a ratio of the distance between the two second sound acquisition components 720 to the vertical distance between the second sound acquisition component 720 and the connecting line (that is, the connecting line between the two first sound acquisition components 710) is 5:2, that is, a ratio of the second length to the third length is 5:4.

For example, in a possible implementation, the second length is 1.5 cm, and the third length is 1.2 cm.

In some embodiments, the sound acquisition component may be a microphone assembly or a pickup assembly.

In some embodiments, the six sound acquisition components are located in the same plane.

In this embodiment of this application, to achieve a better audio signal acquisition effect and reduce the complexity of audio signal processing, the six sound acquisition components shown in FIG. 7 may be disposed in the same plane.

FIG. 8 to FIG. 14 show intrinsic lobe patterns of three sound acquisition component arrays from different main azimuth angles according to the embodiments of this application.

Figure 8:
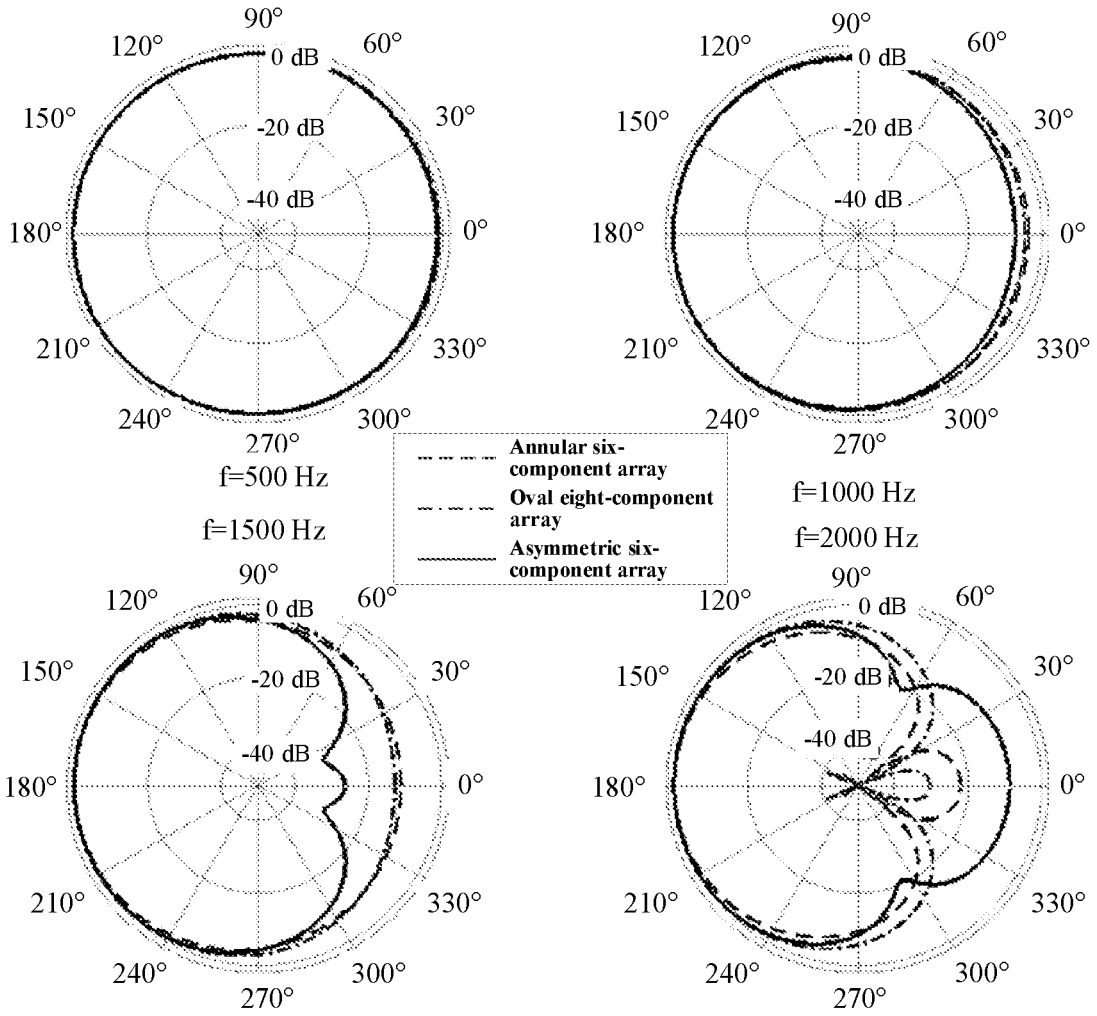
FIG. 8 to FIG. 14 are intrinsic lobe patterns of three sound acquisition component arrays from different main azimuth angles according to the embodiment shown in FIG. 7.

FIG. 8 shows intrinsic lobe patterns of an annular array with six sound acquisition components (briefly referred to as annular six-component array in the figure) corresponding to FIG. 2, an oval array with eight sound acquisition components (briefly referred to as oval eight-component array in the figure) corresponding to FIG. 4, and an asymmetric oval array with six sound acquisition components (briefly referred to as asymmetric six-component array in the figure) according to this embodiment of this application when $\varphi_0$=180 0 and f=500 Hz, 1000 Hz, 1500 Hz and 2000 Hz.

Figure 9:
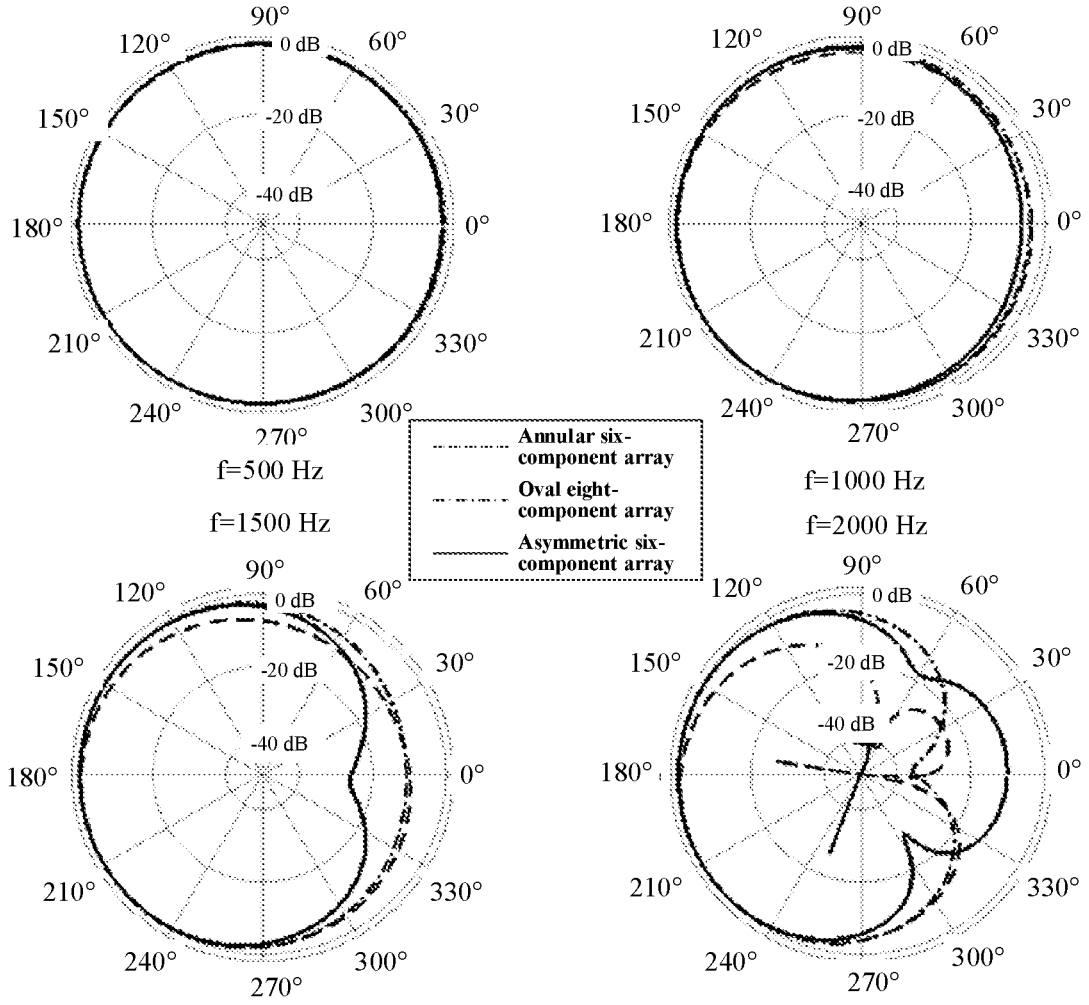

FIG. 9 shows intrinsic lobe patterns of an annular array with six sound acquisition components corresponding to FIG. 2, an oval array with eight sound acquisition components corresponding to FIG. 4, and an asymmetric oval array with six sound acquisition components according to an embodiment of this application when $\varphi_0$=210° and f=500 Hz, 1000 Hz, 1500 Hz and 2000 Hz.

Figure 10:
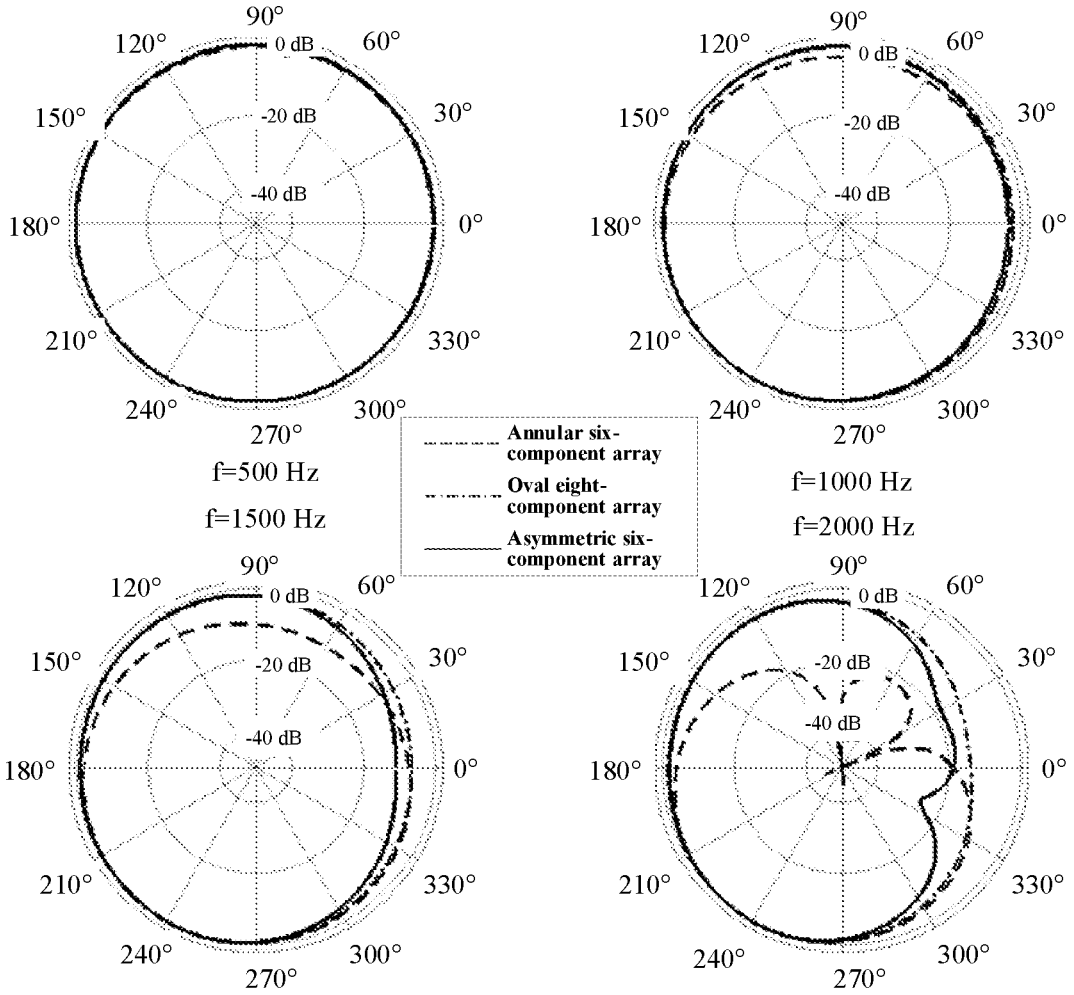

FIG. 10 shows intrinsic lobe patterns of an annular array with six sound acquisition components corresponding to FIG. 2, an oval array with eight sound acquisition components corresponding to FIG. 4, and an asymmetric oval array with six sound acquisition components according to an embodiment of this application when $\varphi_0$=240° and f=500 Hz, 1000 Hz, 1500 Hz and 2000 Hz.

Figure 11:
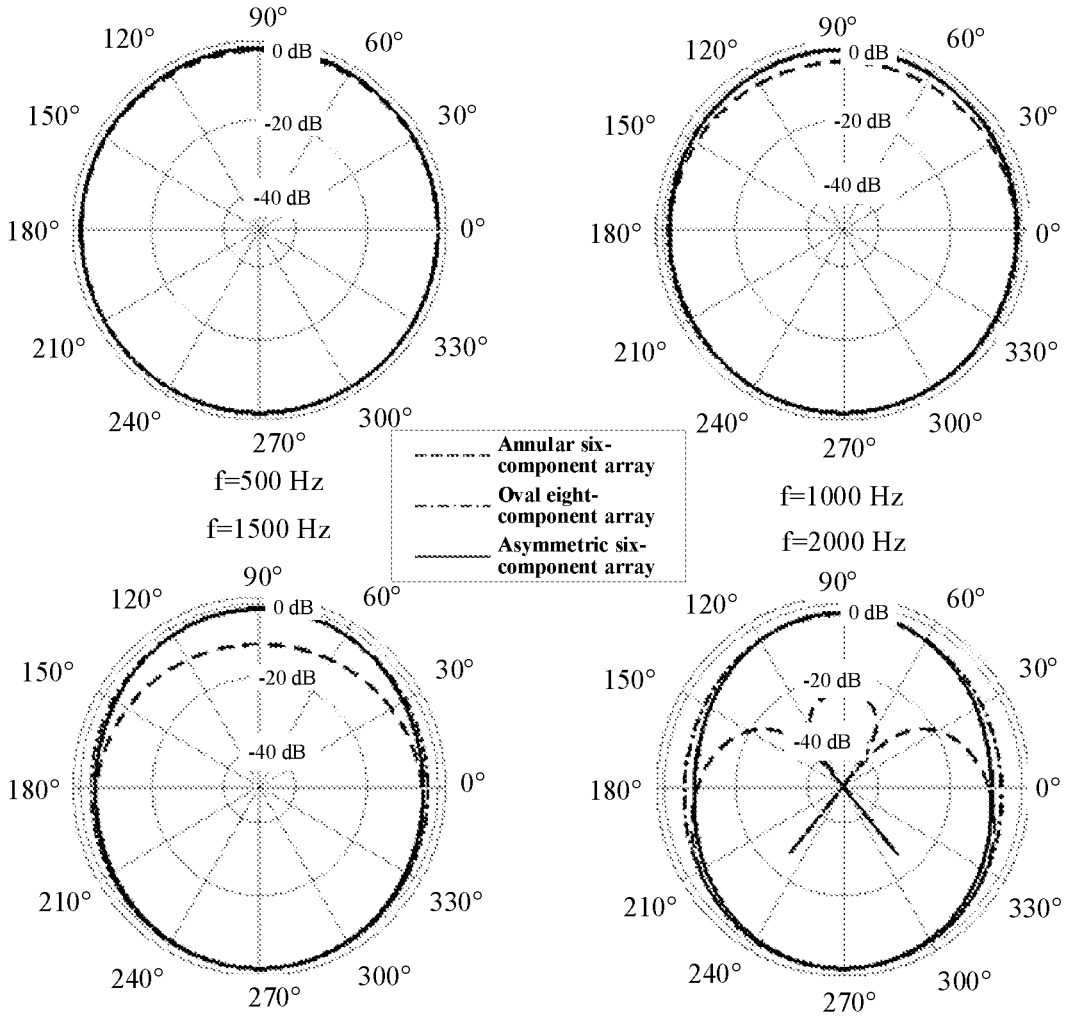

FIG. 11 show intrinsic lobe patterns of an annular array with six sound acquisition components corresponding to FIG. 2, an oval array with eight sound acquisition components corresponding to FIG. 4, and an asymmetric oval array with six sound acquisition components according to an embodiment of this application when $\varphi_0$=270° and f=500 Hz, 1000 Hz, 1500 Hz and 2000 Hz.

Figure 12:
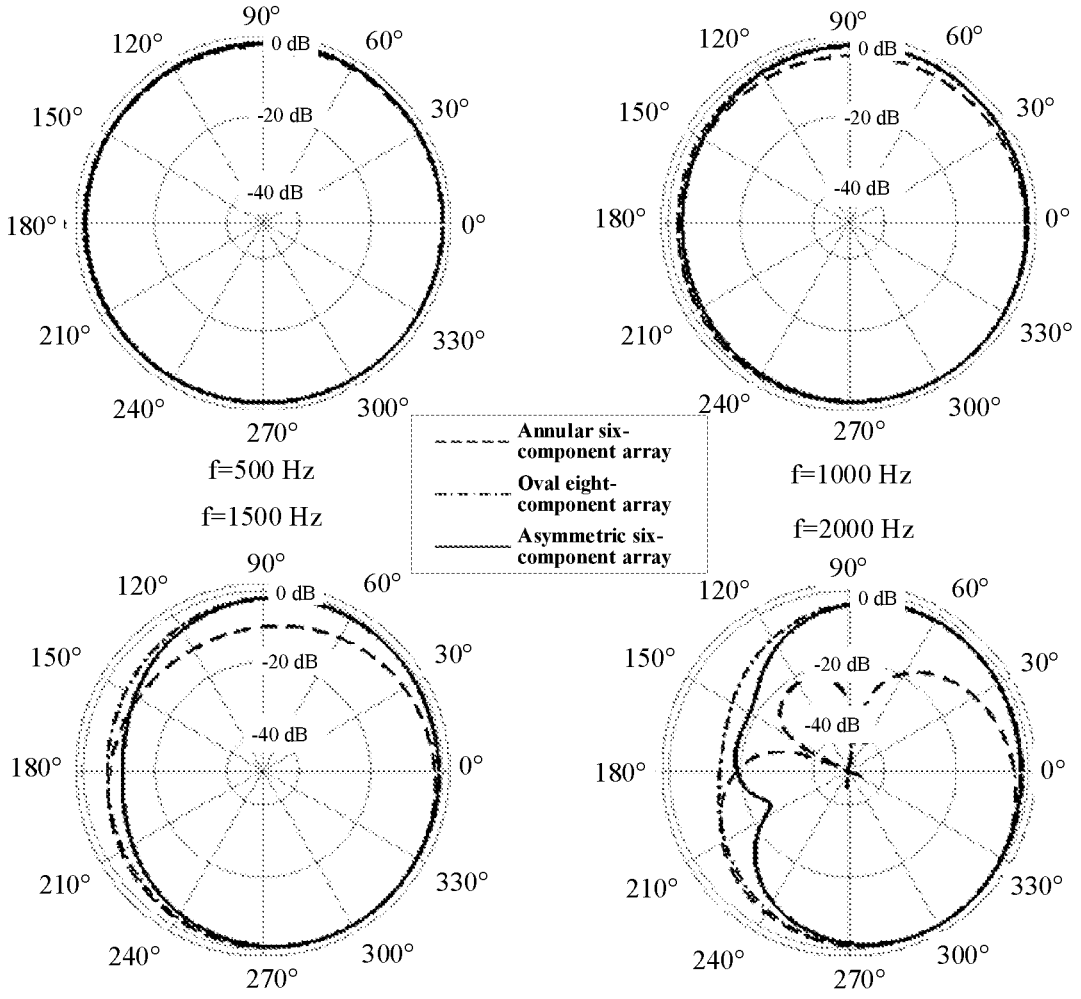

FIG. 12 show intrinsic lobe patterns of an annular array with six sound acquisition components corresponding to FIG. 2, an oval array with eight sound acquisition components corresponding to FIG. 4, and an asymmetric oval array with six sound acquisition components according to an embodiment of this application when $\varphi_0$=300° and f=500 Hz, 1000 Hz, 1500 Hz and 2000 Hz.

Figure 13:
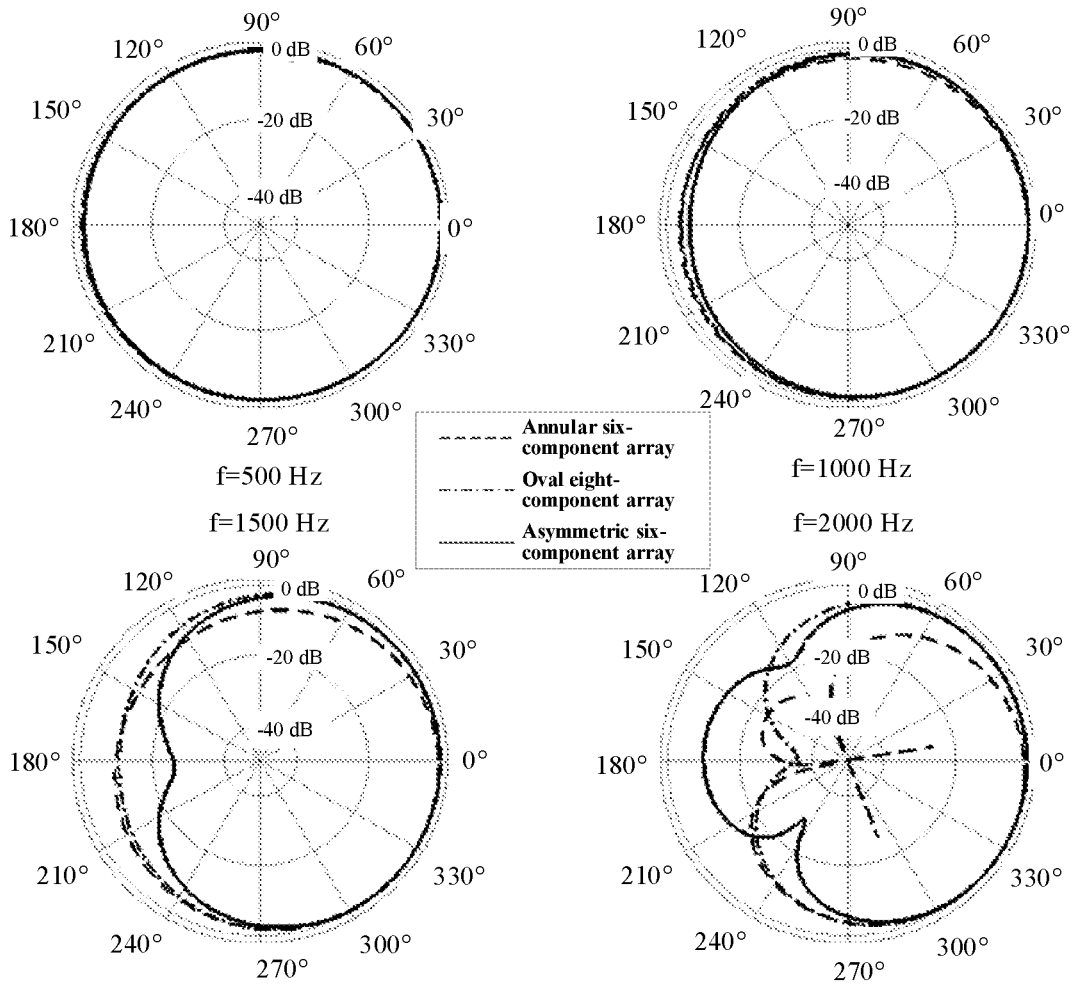

FIG. 13 show intrinsic lobe patterns of an annular array with six sound acquisition components corresponding to FIG. 2, an oval array with eight sound acquisition components corresponding to FIG. 4, and an asymmetric oval array with six sound acquisition components according to an embodiment of this application when $\varphi_0$=330° and f=500 Hz, 1000 Hz, 1500 Hz and 2000 Hz.

Figure 14:
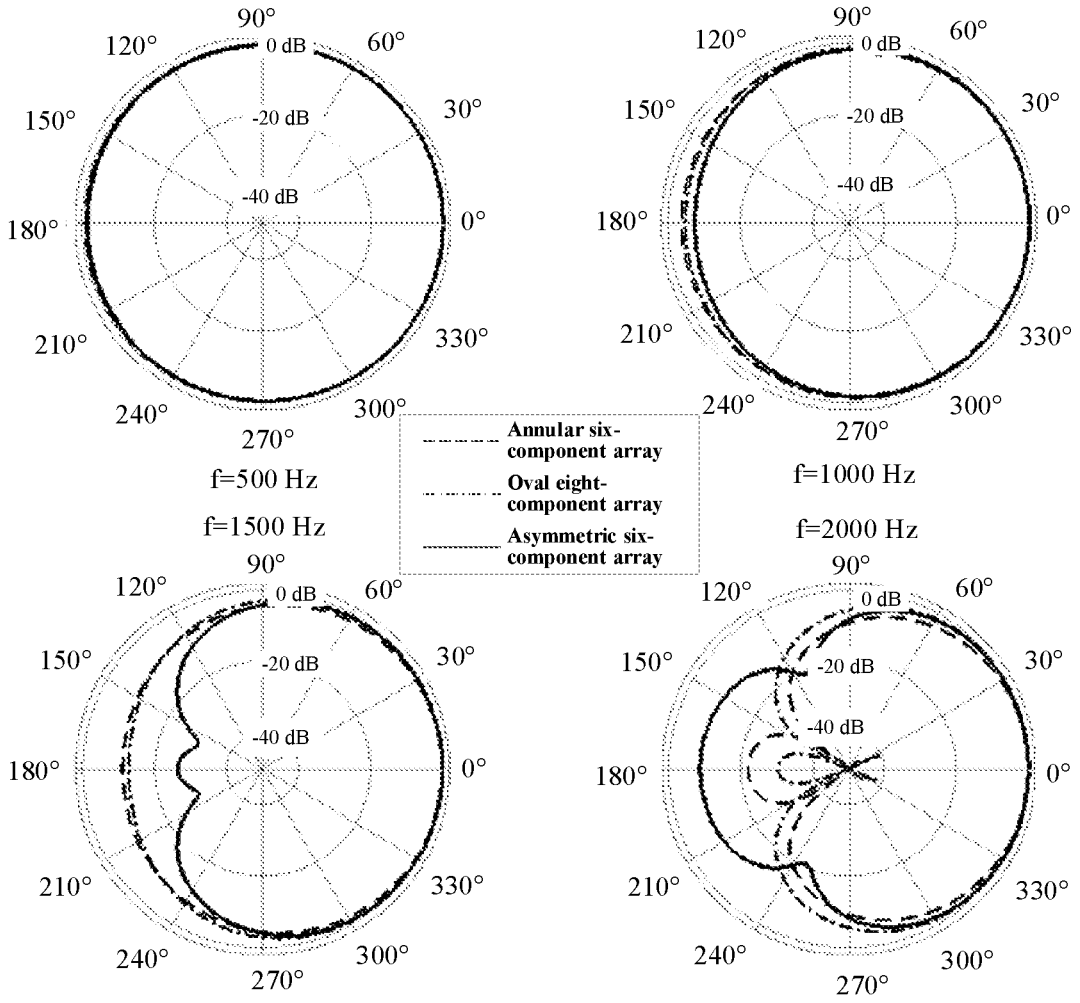

FIG. 14 show intrinsic lobe patterns of an annular array with six sound acquisition components corresponding to FIG. 2, an oval array with eight sound acquisition components corresponding to FIG. 4, and an asymmetric oval array with six sound acquisition components according to an embodiment of this application when $\varphi_0$=360° and f=500 Hz, 1000 Hz, 1500 Hz and 2000 Hz.

Using the sound acquisition component being a microphone as an example, it can be learned from a comparison of the intrinsic lobe patterns of FIG. 8 to FIG. 14 that:

1. when f is below 1500 Hz, the spatial resolution performance of the asymmetric oval array with six mics is not worse than, or is even better than that of the oval array with eight mics, which is embodied in better side lobe suppression performance and a smaller main lobe width of the intrinsic lobe pattern;
2. when f is above 1500 Hz, when a main lobe direction is close to 0° or 180° the main lobe width of the asymmetric oval array with six mics is still smaller than that of the oval array with eight mics; and
3. when f is above 1500 Hz, when a main lobe direction is close to 270° the main lobe width of the asymmetric oval array with six mics is still smaller than that of the oval array with eight mics, and the side lobe suppression performance is not worse than, or is even better than that of the oval array with eight mics.

In view of this, the asymmetric array with six mics shown in this application is more adaptive to layout in a narrow plane than the annular array with six mics, and can support a more flexible appearance design of a smart hardware product. In addition, by using fewer microphones than that in the oval array with eight mics, hardware costs and calculation complexity are reduced. Moreover, better spatial separation performance is obtained around a main direction (270°) used by a user.

Based on the above, the solution in this embodiment of this application provides an array with six sound acquisition components, which is symmetrical about a perpendicular bisector of a connecting line between two sound acquisition components, but is not symmetrical about the connecting line between the two sound acquisition components. The array with six sound acquisition components can adapt to an elongated appearance design extending along a direction of the connecting line between the two sound acquisition components. In this case, the array with six sound acquisition components has fewer sound acquisition components compared with an array with eight sound acquisition components, and less data needs to be processed during audio signal processing, thereby improving the efficiency of audio signal processing while achieving better adaptability to the elongated appearance design.

In another exemplary embodiment of this application, a sound acquisition device is further provided and includes the foregoing sound acquisition component array shown in FIG. 6 or FIG. 7.

In some embodiments, the sound acquisition component array is horizontally disposed on a top surface of the sound acquisition device or is vertically disposed on a front surface of the sound acquisition device.

The top surface is an outer surface facing upward when the sound acquisition device is placed according to a designated pose, and the front surface is a designated outer surface among outer surfaces facing in a horizontal direction when the sound acquisition device is placed according to a designated pose.

The designated pose is an installation or placement pose of the sound acquisition device for normal use according to a design requirement.

For example, the designated pose may be an installation or placement pose of the sound acquisition device according to instructions. In another example, the designated pose may be an installation or placement pose of the sound acquisition device according to instructions of a device operating manual.

Alternatively, the designated pose may be a determined installation or a placement pose according to an installation/placement instruction assembly (for example, a support frame, an anti-slip mat, and mounting holes reserved for wall mount components) in the sound acquisition device. For example, when a surface of the sound acquisition device is provided with a support frame or an anti-slip mat, the designated pose is a pose in which the surface where the support frame or the anti-slip mat is located is vertically downward; or when a mounting hole reserved for a wall mount component is provided on a surface of the sound acquisition device, the designated pose is a pose in which the surface where the mounting hole is located is perpendicular to a horizontal plane.

Figure 15:
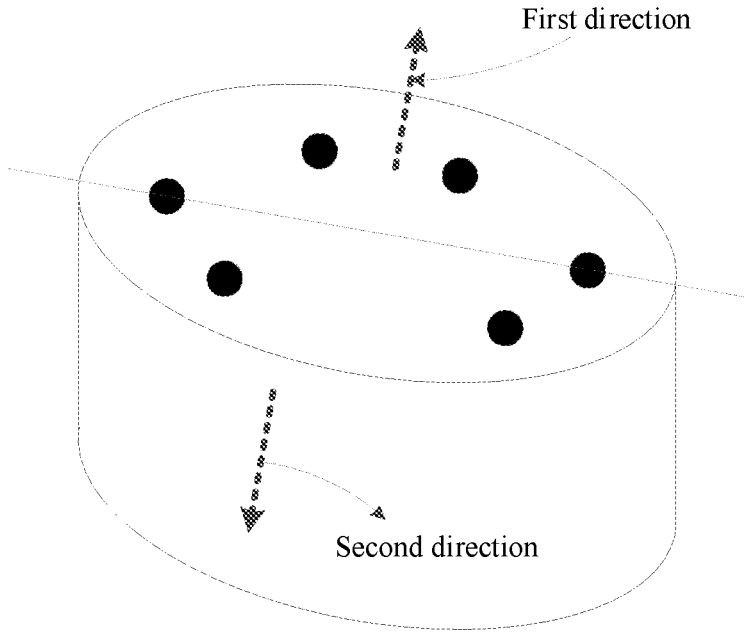
FIG. 15 and FIG. 16 are schematic diagrams of two sound acquisition component arrays horizontally disposed on a top surface of a device.
Figure 16:
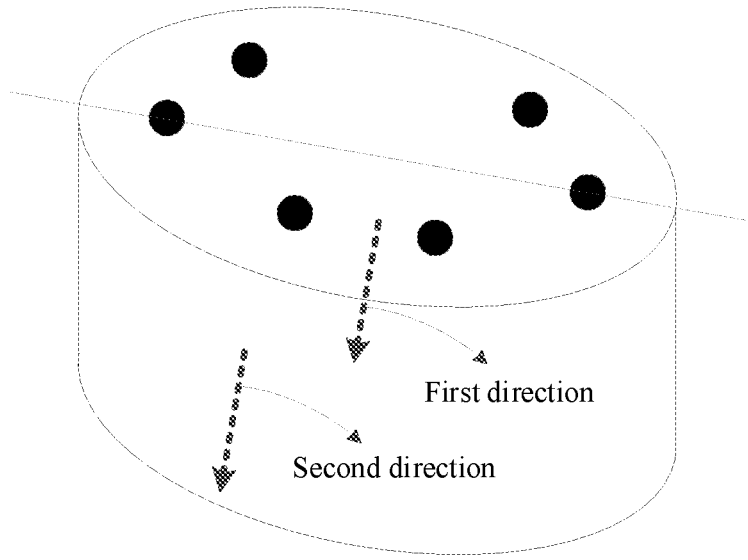

FIG. 15 and FIG. 16 are schematic diagrams of two sound acquisition component arrays horizontally disposed on a top surface of a device. For example, the sound acquisition device is a smart speaker having an oval top surface and the sound acquisition component is a mic. As shown in FIG. 15 and FIG. 16, an asymmetric array with six mics is arranged along a direction of a long axis of the oval top surface of the smart speaker. A minimum length of a long symmetry axis on the top surface of the smart speaker may be designed to be a distance between the two first sound acquisition components, and a minimum length of a short symmetry axis on the top surface of the smart speaker may be designed to be the sum of the third length and the fifth length.

Figure 17:
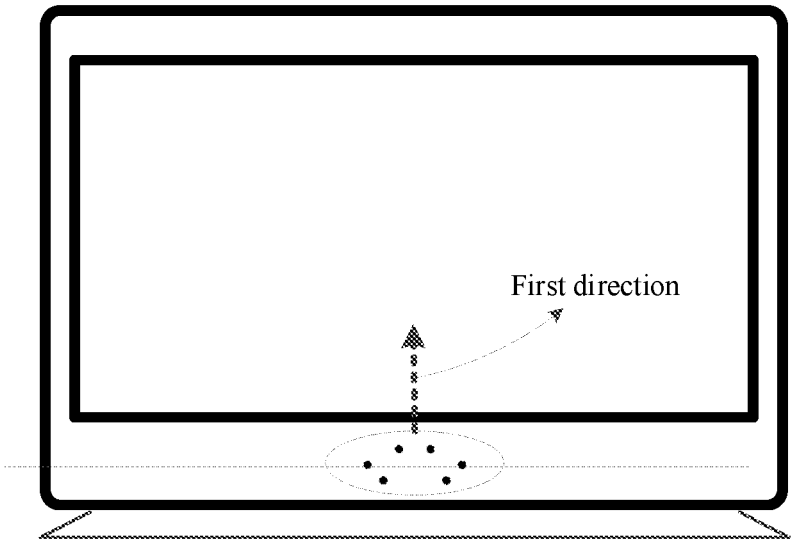
FIG. 17 and FIG. 18 are schematic diagrams of two sound acquisition component arrays vertically disposed on a front surface of a device.
Figure 18:
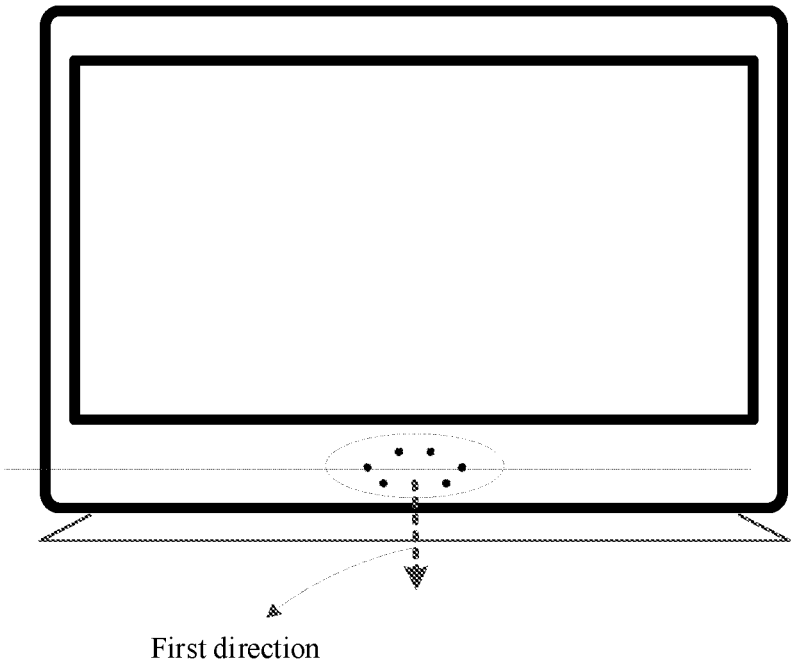

FIG. 17 and FIG. 18 are schematic diagrams of two sound acquisition component arrays vertically disposed on a front surface of a device. For example, the sound acquisition device is a smart television including an elongated area outside a front screen and the sound acquisition component is a mic. As shown in FIG. 17 and FIG. 18, the asymmetric array with six mics is disposed on the elongated area below the front surface of the smart television, and a direction of a line connecting the two first sound acquisition components is a horizontal direction.

In some embodiments, when the sound acquisition component array is horizontally disposed on a top surface of the sound acquisition device, a first direction pointed to by a perpendicular bisector of the connecting line between the two first sound acquisition components is the same as or opposite to a second direction that a front surface of the sound acquisition device faces towards.

In this embodiment of this application, the sound acquisition device may be a smart device having a long elongated top surface. To achieve the best sound acquisition effect, in such a smart device, a direction of a symmetry axis of the oval array with six sound acquisition components (that is, the vertical coordinate direction of the rectangular coordinate system corresponding to the sound acquisition component array shown in FIG. 6 or FIG. 7) is the same as or opposite to the front surface of the sound acquisition device.

For example, in FIG. 15, for the asymmetric array with six mics arranged according to a rectangular coordinate system, a direction pointed to by the y-axis of the rectangular coordinate system (that is, the first direction in FIG. 15) is opposite to a direction that a front surface of the smart speaker faces towards (that is, the second direction in FIG.

Alternatively, in FIG. 16, for the asymmetric array with six mics arranged according to a rectangular coordinate system, a direction pointed to by the y-axis of the rectangular coordinate system (that is, the first direction in FIG. 16) is opposite to a direction that a front surface of the smart speaker faces towards (that is, the second direction in FIG. 16).

Alternatively, when the sound acquisition component array is vertically disposed on the front surface of the sound acquisition device, a third direction pointed to by the perpendicular bisector of the connecting line between the two first sound acquisition components is a vertical upward direction or a vertical downward direction.

For example, in FIG. 17, the orientation of a front surface of the smart television is in a horizontal plane, and for the asymmetric array with six mics arranged according to a rectangular coordinate system, a direction pointed to by the y-axis of the rectangular coordinate system (that is, the first direction in FIG. 17) is a vertical upward direction.

For example, in FIG. 18, the orientation of a front surface of the smart television is in a horizontal plane, and for the asymmetric array with six mics arranged according to a rectangular coordinate system, a direction pointed to by the y-axis of the rectangular coordinate system (that is, the first direction in FIG. 18) is a vertical downward direction.

Other embodiments of this application will be apparent to a person skilled in the art from consideration of the specification and practice of the disclosure here. This application is intended to cover any variations, uses or adaptive changes of this application. Such variations, uses or adaptive changes follow the general principles of this application, and include well-known knowledge and conventional technical means in the art that are not disclosed in this application. The specification and the embodiments are considered as merely exemplary, and the scope and spirit of this application are pointed out in the following claims.

It is to be understood that this application is not limited to the precise structures described above and shown in the accompanying drawings, and various modifications and changes can be made without departing from the scope of this application. The scope of this application is described by the appended claims.

The foregoing descriptions are merely exemplary embodiments of this application, but are not intended to limit this application. Any modification, equivalent replacement, or improvement made within the spirit and principle of this application shall fall within the protection scope of this application.

What is claimed is:

1. A sound acquisition component array, comprising six sound acquisition components that include two first sound acquisition components, two second sound acquisition components, and two third sound acquisition components;

the two second sound acquisition components are located at a first side of a first line connecting the two first sound acquisition components, the two third sound acquisition components are located at a second side of the first line that is opposite to the first side of the first line;

the two second sound acquisition components are symmetrically positioned to each other with respect to a second line, wherein the second line is a perpendicular bisector of the first line;

the two third sound acquisition components are symmetrically positioned to each other with respect to the second line;

a first distance between the two first sound acquisition components along a first direction of the first line, a second distance between the two second sound acquisition components along a second direction parallel to the first line, and a third distance between the two third sound acquisition components along a third direction parallel to the first line being respectively different from one another; and each of the first distance, the second distance, and the third distance is divided into two halves by the second line that is perpendicular to the first line, such that each pair of the two first sound acquisition components, the two second sound acquisition components, and the two third sound acquisition components are located on two opposite sides of the second line.

2. The sound acquisition component array according to claim 1, wherein the first distance between the two first sound acquisition components is three times the second distance between the two second sound acquisition components; and the third distance between the two third sound acquisition components is twice the second distance between the two second sound acquisition components.

3. The sound acquisition component array according to claim 2, wherein a vertical distance between the two second sound acquisition components and the first line is the same as that between the two third sound acquisition components and the first line.

4. The sound acquisition component array according to claim 3, wherein:

a ratio of the second distance between the two second sound acquisition components to the vertical distance between the two second sound acquisition components and the first line is 5:2.

5. The sound acquisition component array according to claim 1, wherein the sound acquisition component array is a microphone assembly or a pickup assembly.

6. The sound acquisition component array according to claim 1, wherein the six sound acquisition components are located on the same plane.

7. The sound acquisition component array according to claim 1, wherein the sound acquisition component array is horizontally disposed on a top surface of a sound acquisition device, and the top surface is an outer surface facing upward when the sound acquisition device is placed according to a designated pose;

or the sound acquisition component array is vertically disposed on a front surface of the sound acquisition device, and the front surface is a designated outer surface among outer surfaces in a horizontal direction when the sound acquisition device is placed according to a designated pose.

8. The sound acquisition component array according to claim 7, wherein when the sound acquisition component array is horizontally disposed on the top surface of the sound acquisition device, a first direction pointed to by a perpendicular bisector of the first line between the two first sound acquisition components is the same as or opposite to a second direction that the front surface of the sound acquisition device faces towards.

9. The sound acquisition component array according to claim 7, wherein when the sound acquisition component array is vertically disposed on the front surface of the sound acquisition device, a third direction pointed to by a perpendicular bisector of the first line between the two first sound acquisition components is a vertical upward direction or a vertical downward direction.

10. The sound acquisition component array according to claim 7, wherein the sound acquisition device is one selected from the group consisting of a smart speaker, a smart television, a smart television set-top box, a smart robot, and a smart in-vehicle device.

11. A sound acquisition component array, comprising six sound acquisition components that include two first sound acquisition components, two second sound acquisition components, and two third sound acquisition components;

the two second sound acquisition components are located at a first side of a first line connecting the two first sound acquisition components, the two third sound acquisition components are located at a second side of the first line that is opposite to the first side of the first connecting line;

the two second sound acquisition components are symmetrically positioned to each other with respect to a second line, wherein the second line is a perpendicular bisector of the first line;

the two third sound acquisition components are symmetrically positioned to each other with respect to the second line;

a first distance between the two first sound acquisition components along a first direction of the first line is greater than a third distance between the two third sound acquisition components along a third direction parallel to the first line and the third distance between the two third sound acquisition components along the third direction being greater than a second distance between the two second sound acquisition components along a second direction parallel to the first line; and each of the first distance, the second distance, and the third distance is divided into two halves by the second line that is perpendicular to the first line, such that each pair of the two first sound acquisition components, the two second sound acquisition components, and the two third sound acquisition components are located on two opposite sides of the second line.

12. The sound acquisition component array according to claim 11, wherein:

the first distance between the two first sound acquisition components is three times the second distance between the two second sound acquisition components; and the third distance between the two third sound acquisition components is twice the second distance between the two second sound acquisition components.

13. The sound acquisition component array according to claim 12, wherein a vertical distance between the two second sound acquisition components and the first line is the same as that between the two third sound acquisition components and the first line.

14. The sound acquisition component array according to claim 13, wherein:

a ratio of the second distance between the two second sound acquisition components to the vertical distance between the two second sound acquisition components and the first line is 5:2.

15. The sound acquisition component array according to claim 11, wherein the sound acquisition component array is a microphone assembly or a pickup assembly.

16. The sound acquisition component array according to claim 11, wherein the six sound acquisition components are located on the same plane.

17. The sound acquisition component array according to claim 11, wherein the sound acquisition component array is horizontally disposed on a top surface of a sound acquisition device, and the top surface is an outer surface facing upward when the sound acquisition device is placed according to a designated pose;

or the sound acquisition component array is vertically disposed on a front surface of the sound acquisition device, and the front surface is a designated outer surface among outer surfaces in a horizontal direction when the sound acquisition device is placed according to a designated pose.

18. The sound acquisition component array according to claim 17, wherein:

when the sound acquisition component array is horizontally disposed on the top surface of the sound acquisition device, a first direction pointed to by a perpendicular bisector of the first line between the two first sound acquisition components is the same as or opposite to a second direction that the front surface of the sound acquisition device faces towards.

19. The sound acquisition component array according to claim 17, wherein:

when the sound acquisition component array is vertically disposed on the front surface of the sound acquisition device, a third direction pointed to by a perpendicular bisector of the first line between the two first sound acquisition components is a vertical upward direction or a vertical downward direction.

20. The sound acquisition component array according to claim 17, wherein the sound acquisition device is one selected from the group consisting of a smart speaker, a smart television, a smart television set-top box, a smart robot, and a smart in-vehicle device.

* * * * *